US006572704B2

(12) United States Patent
Keller

(10) Patent No.: US 6,572,704 B2
(45) Date of Patent: Jun. 3, 2003

(54) APPARATUS FOR PROTECTING CYLINDER WALLS OF AN ENGINE BLOCK DURING A THERMAL COATINGS OPERATION

(75) Inventor: Silvano Keller, Böttstein (CH)

(73) Assignee: Sulzer Metco AG, Wohlen (CH)

( * ) Notice: Subject to any disclaimer, the term of this patent is extended or adjusted under 35 U.S.C. 154(b) by 0 days.

(21) Appl. No.: 09/815,611

(22) Filed: Mar. 23, 2001

(65) Prior Publication Data

US 2001/0029886 A1 Oct. 18, 2001

(30) Foreign Application Priority Data

May 3, 2000 (CH) ..... 0862/00

(51) Int. Cl.[7] ..... B05C 21/00
(52) U.S. Cl. ..... 118/504; 118/505
(58) Field of Search ..... 118/504, 505; 427/282

(56) References Cited

U.S. PATENT DOCUMENTS 4,264,647 A * 4/1981 Trevorrow ..... 427/282
5,271,967 A 12/1993 Kramer et al.
5,573,814 A 11/1996 Donovan
5,691,018 A 11/1997 Kelley et al.
5,792,265 A 8/1998 Maier et al.

FOREIGN PATENT DOCUMENTS

EP 0 641 875 A1 8/1995
JP 06065711 8/1994

* cited by examiner

*Primary Examiner*—Laura Edwards
(74) *Attorney, Agent, or Firm*—Maginot, Moore & Bowman

(57) ABSTRACT

Disclosed is an apparatus for protecting the walls of a row of cylinders of an engine block from contamination when the walls of the other row of cylinders of the engine block are thermally coated. For this purpose, the apparatus comprises a plurality of inflatable hollow body members that can be moved into the interior of the cylinders whose walls are to be protected and inflated once they are in position in the interior of the particular cylinders. The hollow body members comprise a dimensionally stable inner sleeve member that is enclosed by an inflatable elastic envelope member. The inflatable hollow body members are arranged in two groups located opposite to each other.

7 Claims, 1 Drawing Sheet

APPARATUS FOR PROTECTING CYLINDER WALLS OF AN ENGINE BLOCK DURING A THERMAL COATINGS OPERATION

BACKGROUND OF THE INVENTION

The present invention refers to an apparatus for protecting the walls of particular cylinders during the thermal coating of the walls of other cylinders of an engine block.

Nowadays, in manufacturing combustion engines, more and more engine blocks made of a light metal alloy are used whose cylinder walls are provided with an iron-containing coating layer applied by means of a thermal spraying apparatus. Thereby, for applying that coating, preferably plasmatrons are in use that have a rotating spraying head. Since, normally, not all cylinder walls of an engine block can be coated simultaneously, those cylinder walls that are not subjected to the thermal spraying operation have to be protected from contamination.

Particularly in the case of engine blocks of so-called V-engines or flat engines, this is of increased importance since one row of cylinders is located opposite another row of cylinders, with the result that the cylinder walls of the row of cylinders opposite to the one that is actively coated can be contaminated. Such a contamination can be caused, for example, by particles sprayed towards the cylinder wall to be coated, but do not adhere thereto. Moreover, by the flow of gases inevitable during a thermal coating operation, also dust particles are entrained which can deposit on the walls of the cylinders not subjected to the coating operation, thus leading to an undesired encapsulation of particles in the coating subsequently to be applied to that particular cylinder wall.

OBJECTS OF THE INVENTION

It is an object of the present invention to provide an apparatus for protecting cylinder walls of an engine block during a thermal coating operation that is of simple design and can be easily and quickly used.

SUMMARY OF THE INVENTION

To meet these and other objects, the present invention provides an apparatus for protecting the walls of particular cylinders during the thermal coating of the walls of other cylinders of an engine block. The apparatus of the invention comprises a plurality of hollow body members having a first outer diameter that is smaller than the diameter of a cylinder bore to be protected. The hollow body members are inflatable to a diameter that is greater than the diameter of the cylinder bore to be protected. The apparatus further comprises means for moving the hollow body members into the cylinders whose walls are to be protected and for removing the hollow body members therefrom when they have the afore mentioned first diameter. Finally, means are provided for inflating the hollow body members when they are moved into the cylinders whose walls have to be protected, and means for deflating the hollow body members prior to actuating the means for removing the hollow body members from the cylinders whose walls are to be protected.

By providing an apparatus for protecting the cylinder walls of engine blocks during the coating of particular cylinders, which comprises inflatable hollow body members that can be moved into the cylinders and inflated therein, the walls of those cylinders located opposite the cylinders subjected to the coating operation can be easily and efficiently protected from contamination.

BRIEF DESCRIPTION OF THE DRAWINGS

In the following, an embodiment of the apparatus according to the invention will be further described, with reference to the accompanying drawings, in which.

DESCRIPTION OF A PREFERRED EMBODIMENT

Figure 1:
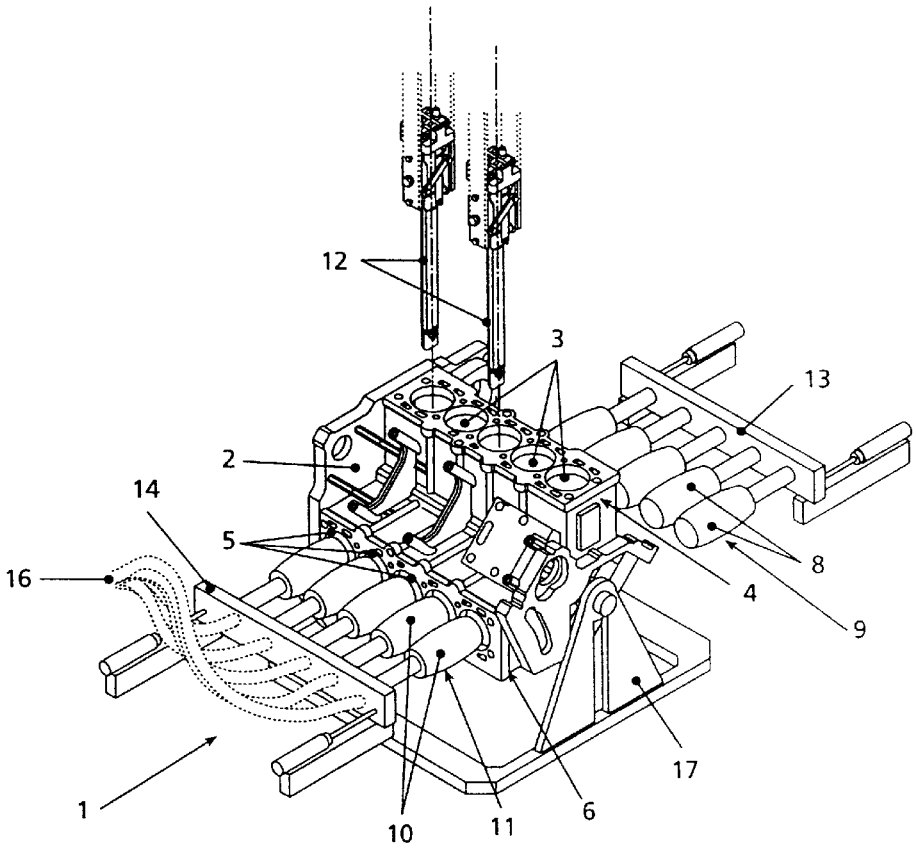
FIG. 1 shows a schematic, perspective view of an engine block and of the apparatus of the invention.

FIG. 1 shows a schematic, perspective view of an apparatus 1 for protecting the walls of particular cylinders during the thermal coating of the walls of other cylinders of an engine block 2. In the present example, the engine block 2 of a V-10 combustion engine is shown; however, it is understood that substantially the same apparatus, appropriately modified, can be used in connection with engine blocks of different designs. The engine block 2 is supported in a frame structure 17 such that it can be rotated into a position in which the cylinders 3 of the cylinder row 4 whose walls have to be thermally coated are vertically orientated, while the cylinders 5 of the cylinder row 6, that might be already thermally coated or will undergo a subsequent thermal coating, are horizontally orientated. Of course, this is true only for the example shown in FIG. 1 in which a V-10 engine block is shown whose cylinder rows 4 and 6 are arranged under an angle of 90° to each other.

It is understood that the expression "cylinder" should be interpreted as "cylinder bore" in most instances.

For thermally coating the walls of the cylinders 3 and 5, for example a plasma spraying apparatus having a rotating spraying head can be used, e.g. as disclosed in U.S. Pat. No. 5,452,854.

In the present example and as shown in FIG. 1, two schematically illustrated plasma spraying apparatuses 12 are provided. However, it is understood that any number of plasma spraying apparatuses could be provided, ranging from one to a number equal to the number of cylinders in a row.

The apparatus 1 for protecting the walls of particular cylinders 3 and 5, respectively, during the thermal coating of the walls of other cylinders 5 and 3, respectively, of an engine block 2 comprises a plurality of hollow body members 8, 10. Since a V-10 engine block is chosen for the present embodiment, a total of ten hollow body members 8, 10 is provided. Five hollow body members 8 form a first group 9 of hollow body members, located at the one side of the frame structure 17, and five hollow body members 10 form a second group 11 of hollow body members, located at the opposite side of the frame structure 17. The hollow body members 8, 10 are connected to a (not shown) source of compressed air via the schematically shown pipes 16. It should be noted that only the pipes 16 leading to the group 11 of hollow body members are shown; however, it is understood that corresponding pipes are provided for the other group 9 of hollow body members.

Each group 9, 11 of hollow body members 8, 10 comprises a supporting frame structure 13, 14 supporting the hollow body members 8, 10. The hollow body members, having a central longitudinal axis A (FIG. 2), are arranged on the frame structures 13 and 14 such that the central longitudinal axis A of each hollow body member 8, 10 is aligned with the central longitudinal axis of one of the cylinders 3, 5 of the engine block 2. The frame structures 13, 14 with the hollow body members 8, 10 attached thereto are horizontally movable such that the hollow body members 8, 10 can be inserted into the associated group of cylinders 3 and 5, respectively, and removed therefrom.

Figure 2:
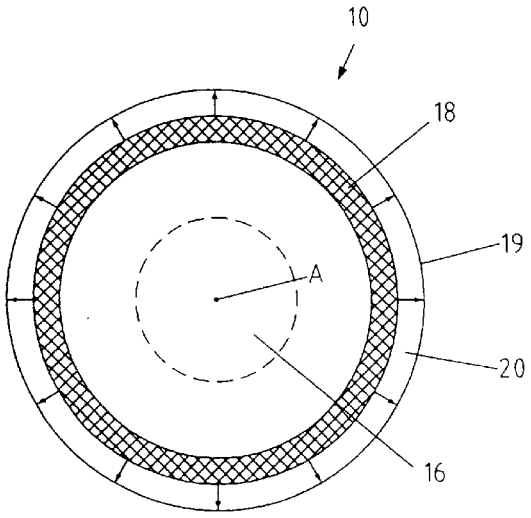
FIG. 2 shows a cross sectional view of a schematically illustrated hollow body member.

FIG. 2 shows an enlarged schematic cross sectional view of a hollow body member 10. It is understood that the hollow body members 8 are of identical design. The hollow body member 10 comprises a dimensionally stable inner sleeve member 18 and an elastic envelope 19 enclosing the sleeve member 18. The envelope 19 is preferably made of silicon material since that material is not only elastic, but also able to withstand high temperatures. As indicated by the arrows shown in FIG. 2, compressed air can be fed into an annular chamber 20 between the inner sleeve member 18 and the envelope 19, with the result that the envelope 19 is radially expanded. Thus, by gradually filling the annular chamber 20 with compressed air, the outer diameter of the envelope 19 increases.

In order to protect the walls of the cylinders 5 of the cylinder row 6 during coating the walls of the cylinders 3 of the cylinder row 4, the hollow body members 10 are inserted into the cylinders 5 of the cylinder row 6 and subsequently inflated by feeding compressed air to the annular chamber 20 between the sleeve member 18 and the envelope 19. In this connection, it should be mentioned that the hollow body members 8, 10 are somewhat longer than the cylinder bores 5. Thus, the hollow body members 10 stand out of the cylinders 5 to a certain extent at both ends. The result is that particularly also the edge and border regions of the cylinder bores 5 are well protected since the outer diameter of the inflated envelope 19 is somewhat greater at the portions located outside the cylinders 5 than at the portions located inside the cylinders 5, thereby forming a sort of protective bulge.

Once the coating of the cylinders 3 is completed, the spraying heads of the spraying apparatus 12 are retracted, the compressed air is released from the hollow body members 10 and the supporting frame structure 14 is moved to remove the hollow body members 10 from the associated cylinders 5. Thereafter, the engine block 2 is rotated to such an extent that the central longitudinal axes of the cylinders 3 are aligned with the central longitudinal axes of the hollow body members 8, and the supporting frame structure 13 is moved to insert the hollow body members 8 into the already coated cylinders 3, where they are inflated as described herein before, and the coating operation of the cylinders 5 is initiated.

Thereby, the hollow body members 8, 10 according to the invention and as herein before described are suitable both for a range of different cylinder diameters and different cylinder lengths. Moreover, the hollow body members can be used for protecting both the cylinder walls to be subsequently coated and already coated cylinder walls.

The embodiment shown in the drawings and described herein before is particularly suitable for engine blocks having V-design and for engine blocks of flat engines, because, upon coating the walls of particular cylinders of such engine blocks, those cylinders located opposite to the cylinders actively being coated are exposed to contamination by the coating material.

What is claimed is:

1. An apparatus for protecting the walls of particular cylinders during the thermal coating of the walls of other cylinders of an engine block, comprising:

a plurality of hollow body means having a first outer diameter smaller than the diameter of a cylinder bore to be protected and being inflatable to a diameter greater than the diameter of said cylinder bore to be protected;

means for moving said hollow body means into said cylinder whose walls are to be protected and for removing said hollow body means therefrom when said hollow body means has said first diameter;

means for inflating said hollow body means when said hollow body means is in the interior of said cylinder whose walls have to be protected; and means for deflating said hollow body means prior to actuating said means for removing said hollow body means from said cylinder whose walls are to be protected, said hollow body means comprises a dimensionally stable inner sleeve means and an elastic inflatable envelope means enclosing said inner sleeve means at least radially.

2. An apparatus according to claim 1 in which said envelope means is made of silicon or of another heat-resistant elastic material.

3. An apparatus according to claim 1 in which half of said plurality of hollow body means are arranged in a first group of inflatable hollow body means and the other half of said plurality of hollow body means are arranged in a second group of inflatable hollow body means, said first and second groups being located opposite to each other.

4. An apparatus for protecting the walls of particular cylinders during the thermal coating of the walls of other cylinders of an engine block, comprising:

a plurality of hollow body means having a first outer diameter smaller than the diameter of a cylinder bore to be protected and being inflatable to a diameter greater than the diameter of said cylinder bore to be protected;

means for moving said hollow body means into said cylinder whose walls are to be protected and for removing said hollow body means therefrom when said hollow body means has said first diameter;

means for inflating said hollow body means when said hollow body means is in the interior of said cylinder whose walls have to be protected; and means for deflating said hollow body means prior to actuating said means for removing said hollow body means from said cylinder whose walls are to be protected, half of said plurality of hollow body means being arranged in a first group of inflatable hollow body means and the other half of said plurality of hollow body means being arranged in a second group of inflatable hollow body means, said first and second groups being located opposite to each other.

5. An apparatus for protecting a first interior wall of a first cylinder of an engine block during application of a coating onto a second interior wall of a second cylinder of the engine block, comprising:

an inflatable member configured to be inflated from a deflated condition to an inflated condition; and a fluid source positioned in fluid communication with said inflatable member and operable to inflate the inflatable member from said deflated condition to said inflated condition, wherein said inflatable member includes a hollow body having a first end portion and a second end portion, and wherein said hollow body is configured to extend through said first cylinder such that said first end portion of said hollow body extends out a first end of said first cylinder and said second end portion of said hollow body extends out a second end of said second cylinder.

6. The apparatus of claim 5, wherein said fluid source is further operable to maintain, while the coating is being applied to the second interior wall of the second cylinder, said inflatable member (i) in said inflated condition, and (ii) an outer surface of said inflatable member in contact with the first interior wall of the first cylinder.

7. The apparatus of claim 5, wherein said hollow body includes (i) an inner sleeve, and (ii) an expandable envelope positioned around the inner sleeve, and said expandable envelope is configured to radially expand during inflation of said inflatable member from said deflated condition to said inflated condition.

* * * * *